US010969156B2

(12) United States Patent
Lee et al.

(10) Patent No.: US 10,969,156 B2
(45) Date of Patent: Apr. 6, 2021

(54) REFRIGERATOR HAVING A SWITCHABLE CHAMBER

(71) Applicant: LG ELECTRONICS INC., Seoul (KR)

(72) Inventors: Sanggyun Lee, Seoul (KR); Younseok Lee, Seoul (KR); Dongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 16/217,615

(22) Filed: Dec. 12, 2018

(65) Prior Publication Data

US 2019/0178559 A1 Jun. 13, 2019

(30) Foreign Application Priority Data

Dec. 13, 2017 (KR) ..... 10-2017-0171652

(51) Int. Cl.

| | |
|---|---|
| ***F25D 11/02*** | (2006.01) |
| ***F25D 17/04*** | (2006.01) |
| ***F25D 17/06*** | (2006.01) |
| ***F25D 17/08*** | (2006.01) |
| ***F25B 5/04*** | (2006.01) |

(52) U.S. Cl.

CPC ..... *F25D 17/045* (2013.01); *F25B 5/04* (2013.01); *F25D 11/022* (2013.01); *F25D 17/065* (2013.01); *F25D 17/067* (2013.01); *F25D 17/08* (2013.01); *F25B 2600/112* (2013.01); *F25B 2600/2507* (2013.01); *F25D 2317/068* (2013.01); *F25D 2700/121* (2013.01); *F25D 2700/122* (2013.01)

(58) Field of Classification Search

CPC ..... F25D 11/022; F25D 17/065; F25D 2317/061; F25B 2600/2511

See application file for complete search history.

(56) References Cited

U.S. PATENT DOCUMENTS 6,055,826 A * 5/2000 Hiraoka ..... F25D 17/065 62/408

2004/0107727 A1 6/2004 Kim et al.

(Continued)

FOREIGN PATENT DOCUMENTS

CN 1504704 A 6/2004

CN 1670450 A 9/2005

(Continued)

*Primary Examiner* — Jonathan Bradford

(74) *Attorney, Agent, or Firm* — Dentons US LLP

(57) ABSTRACT

A refrigerator includes a main body, a damper, a compressor, a condenser, a switchable chamber evaporator, a freezing chamber evaporator, a switchable chamber capillary tube, a bypass capillary tube, a path switching device, a switchable chamber fan, a freezing chamber fan, and a controller. The controller rotates the switchable chamber fan and the freezing chamber fan at different speeds according to satisfaction of a temperature of the switchable chamber, dissatisfaction of the temperature of the switchable chamber, satisfaction of a temperature of the freezing chamber, dissatisfaction of the temperature of the freezing chamber, satisfaction of a temperature of the refrigerating chamber and dissatisfaction of the temperature of the refrigerating chamber.

18 Claims, 10 Drawing Sheets

(56) References Cited

U.S. PATENT DOCUMENTS

| | | | | |
|---|---|---|---|---|
| 2005/0183429 | A1* | 8/2005 | Rafalovich | F25D 21/04 62/155 |
| 2005/0204773 | A1* | 9/2005 | Imai | F25D 11/02 62/512 |
| 2013/0186129 | A1 | 7/2013 | Bae et al. | |
| 2016/0363360 | A1 | 12/2016 | Kim et al. | |

FOREIGN PATENT DOCUMENTS

| | | | |
|---|---|---|---|
| CN | 106247734 | A | 12/2016 |
| CN | 107062669 | A | 8/2017 |
| EP | 1426711 | | 6/2004 |
| EP | 1577622 | A2 | 9/2004 |
| KR | 10-2009-0046251 | A | 5/2009 |

* cited by examiner

REFRIGERATOR HAVING A SWITCHABLE CHAMBER

This application claims priority under 35 U.S.C. 119 and 365 to Korean Patent Application No. 10-2017-0171652, filed on Dec. 13, 2017 in the Korean Intellectual Property Office, the disclosure of which is incorporated herein by reference.

BACKGROUND

1. Field of the Disclosure

The present disclosure relates to a refrigerator, and to a refrigerator having a switchable chamber.

2. Discussion of the Related Art

A refrigerator is a device for cooling or storing objects to be cooled (hereinafter, referred to as food) at a low temperature, such as foods from spoiling or going sour, and preserving medicines and cosmetics.

The refrigerator includes a freezing chamber in which food is stored and a freezing cycle apparatus for cooling the freezing chamber.

The freezing cycle apparatus may include a compressor, a condenser, an expansion device and an evaporator, in which refrigerant is circulated.

The refrigerator may include a freezing chamber maintained at a subzero temperature range and a refrigerating chamber maintained at a temperature range above zero, both of which may be cooled by at least one evaporator.

The refrigerator may include a switchable chamber having a temperature range varying according to a user desire, which may be formed independently of the freezing chamber and the refrigerating chamber. In this case, the switchable chamber may operate as a freezing chamber or a refrigerating chamber by user selection or may be maintained in a temperature range different from those of the freezing chamber and the refrigerating chamber.

An example of a refrigerator having a switchable chamber is disclosed in Korean Laid-Open Patent Publication No. 10-2009-0046251 A (published on May 11, 2009). Such a refrigerator includes a first evaporator for cooling a refrigerating chamber, a second evaporator for simultaneously or selectively cooling a freezing chamber and a switchable chamber, a cold air supply device for selectively suppling cold air generated in the second evaporator to the freezing chamber and the switchable chamber, and a first blowing fan for generating blowing force to forcibly circulate the cold air generated in the first evaporator to the freezing chamber.

The cold air supply device of the refrigerator includes a second blowing fan for selectively forcibly circulating the cold air generated in the second evaporator to the freezing chamber and the switchable chamber to generate blowing force and a damper for controlling an amount of cold air of the switchable chamber and the freezing chamber. The damper includes a first damper formed on a rear wall of the switchable chamber to control the amount of cold air in the switchable chamber and a second damper formed on a rear wall of the freezing chamber to control the amount of cold air in the freezing chamber.

SUMMARY

An object of the present disclosure is to provide a refrigerator including a switchable chamber fan and a freezing chamber fan and capable of optimally controlling the temperatures of a switchable chamber, a freezing chamber, and a refrigerating chamber.

To achieve the above objects, there is provided a refrigerator including a main body having a freezing chamber and a switchable chamber communicating with a refrigerating chamber through a duct, a damper configured to control flow of cold air through the duct, a compressor connected with a compressor suction path and a compressor discharging path, a condenser connected with the compressor discharging path and connected with a condenser discharging path, a switchable chamber evaporator configured to cool the switchable chamber, a freezing chamber evaporator connected with the switchable chamber evaporator through an evaporator connection path to cool the freezing chamber, a switchable chamber capillary tube connected with the switchable chamber evaporator, a bypass capillary tube connected with the evaporator connection path, a path switching device connected with the condenser discharging path, the switchable chamber capillary tube and the bypass capillary tube to guide the refrigerant flowing in the condenser discharging path to the switchable chamber capillary tube or the bypass capillary tube, a switchable chamber fan configured to blow cold air to the switchable chamber evaporator and to blow the cold air to the switchable chamber and to the duct, a freezing chamber fan configured to blow cold air to the freezing chamber evaporator and to blow the cold air to the freezing chamber and to the duct, and a controller configured to close the damper when a temperature of the refrigerating chamber is satisfied and to open the damper when the temperature of the refrigerating chamber is dissatisfied. The controller rotates the switchable chamber fan and the freezing chamber fan at different speeds according to satisfaction of a temperature of the switchable chamber, dissatisfaction of the temperature of the switchable chamber, satisfaction of a temperature of the freezing chamber and dissatisfaction of the temperature of the freezing chamber, satisfaction of a temperature of the refrigerating chamber and dissatisfaction of the temperature of the refrigerating chamber.

When the target temperature of the switchable chamber exceeds a set temperature, the temperature of the refrigerating chamber is dissatisfied, the temperature of the switchable chamber is dissatisfied and the temperature of the freezing chamber is dissatisfied, the controller may control the path switching device to a serial mode, and rotate the switchable chamber fan at a higher speed than the freezing chamber fan.

When the target temperature of the switchable chamber exceeds a set temperature, the temperature of the refrigerating chamber is dissatisfied, the temperature of the switchable chamber is satisfied and the temperature of the freezing chamber is satisfied, the controller may close the path switching device, and rotate the freezing chamber fan at a higher speed than the switchable chamber fan.

When the target temperature of the switchable chamber exceeds a set temperature, the temperature of the refrigerating chamber is dissatisfied, the temperature of the switchable chamber is dissatisfied and the temperature of the freezing chamber is satisfied, the controller may control the path switching device to a serial mode, and rotate the switchable chamber fan at a higher speed than the freezing chamber fan.

When the target temperature of the switchable chamber exceeds a set temperature, the temperature of the refrigerating chamber is dissatisfied, the temperature of the switchable chamber is satisfied and the temperature of the freezing chamber is dissatisfied, the controller may control the path switching device to a freezing chamber mode, and rotate the freezing chamber fan at a higher speed than the switchable chamber fan.

When the target temperature of the switchable chamber exceeds a set temperature, the temperature of the refrigerating chamber is satisfied, the temperature of the switchable chamber is satisfied and the temperature of the freezing chamber is dissatisfied, the controller may control the path switching device to a freezing chamber mode, and rotate the freezing chamber fan at a middle speed between a high speed and a low speed and stop the switchable chamber fan.

When the target temperature of the switchable chamber exceeds a set temperature, the temperature of the refrigerating chamber is satisfied, the temperature of the switchable chamber is dissatisfied and the temperature of the freezing chamber is satisfied, the controller may control the path switching device to a serial mode, and rotate the switchable chamber fan at a middle speed between a high speed and a low speed and stop the freezing chamber fan.

When the target temperature of the switchable chamber exceeds a set temperature, the temperature of the refrigerating chamber is satisfied, the temperature of the switchable chamber is dissatisfied and the temperature of the freezing chamber is dissatisfied, the controller may control the path switching device to a serial mode, and rotate the switchable chamber fan and the freezing chamber fan at a middle speed between a high speed and a low speed.

When the target temperature of the switchable chamber exceeds a set temperature, the temperature of the refrigerating chamber is satisfied, the temperature of the switchable chamber is satisfied and the temperature of the freezing chamber is satisfied, the controller may close the path switching device, and stop the switchable chamber fan and the freezing chamber fan.

The set temperature may be higher than a maximum target temperature of the freezing chamber.

DETAILED DESCRIPTION OF THE PREFERRED EMBODIMENTS

Hereinafter, detailed embodiments of the present disclosure will be described in detail with reference to the accompanying drawings.

Figure 1:
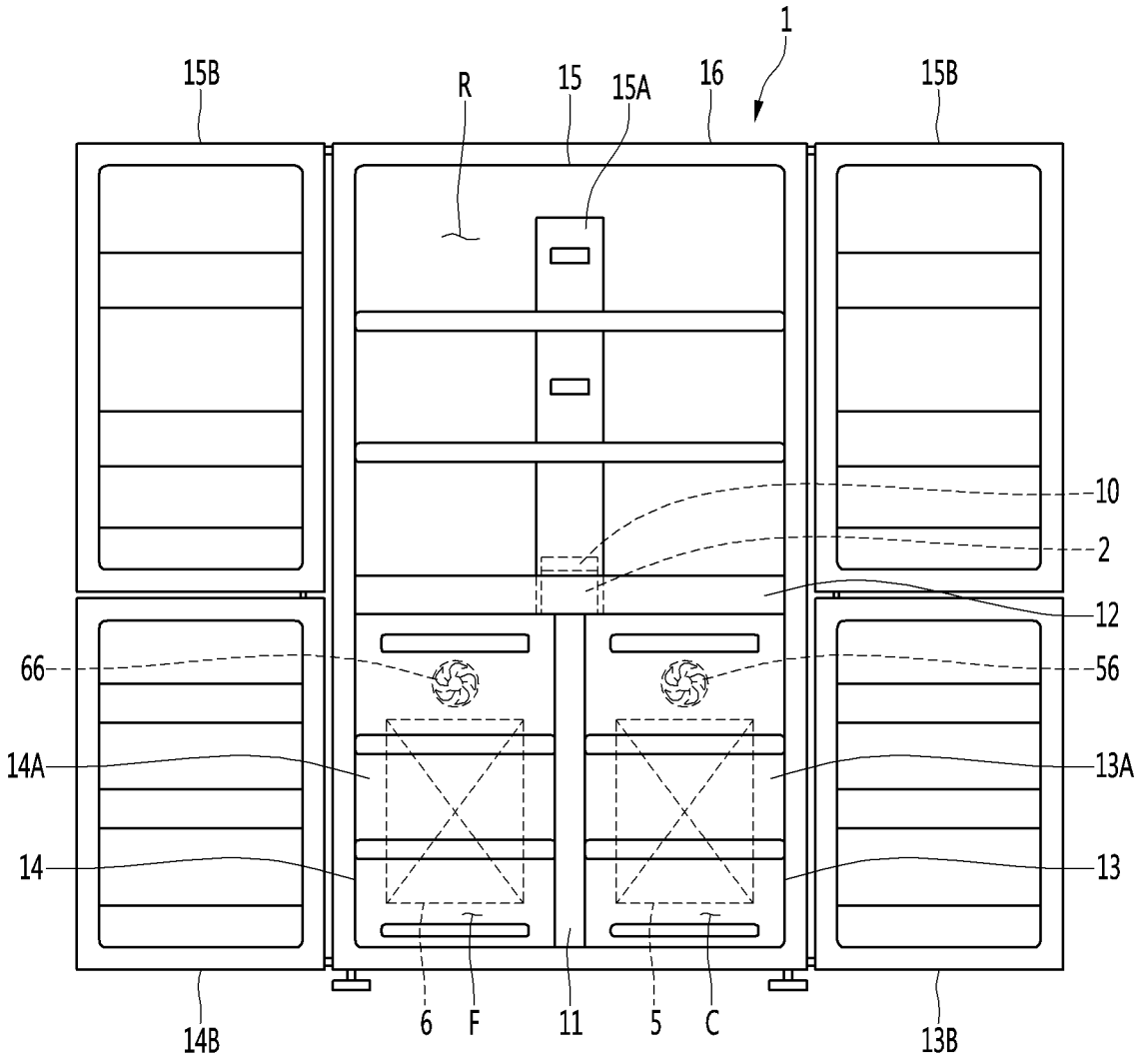
FIG. 1 is a diagram showing a configuration of a refrigerator according to an embodiment of the present disclosure.
Figure 2:
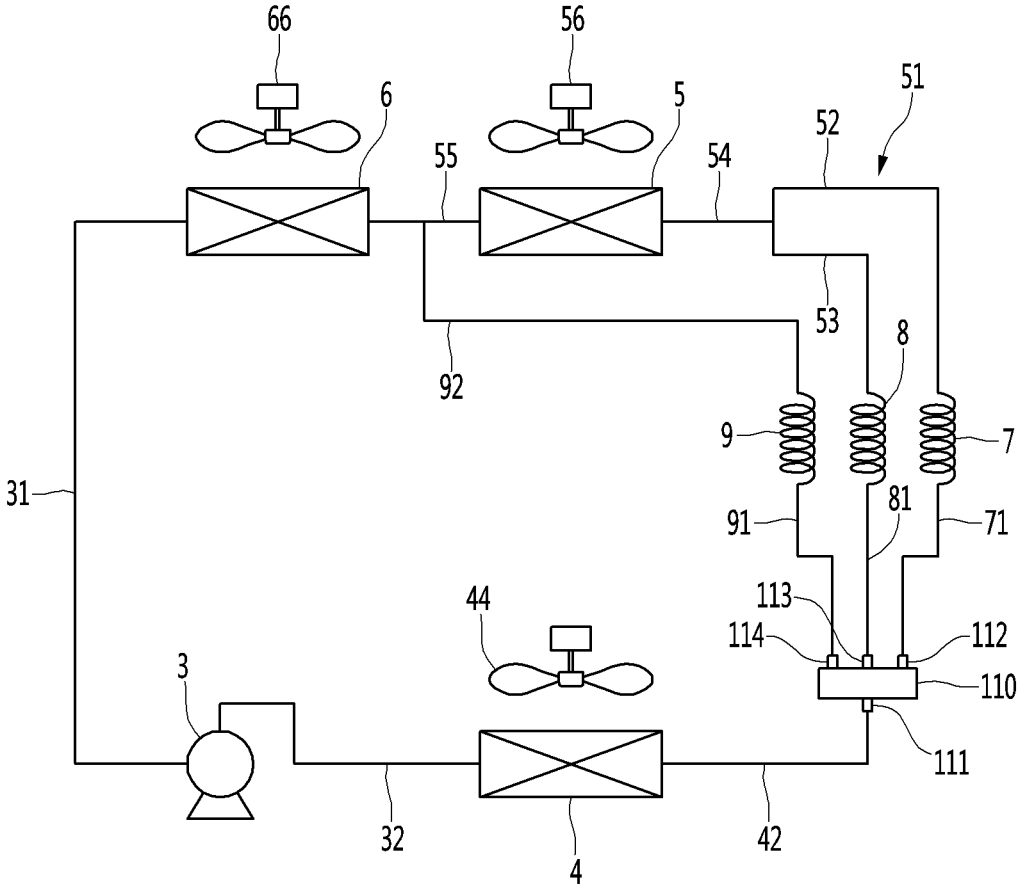
FIG. 2 is a cross-sectional view showing an inside of the refrigerator according to the embodiment of the present disclosure.
Figure 3:
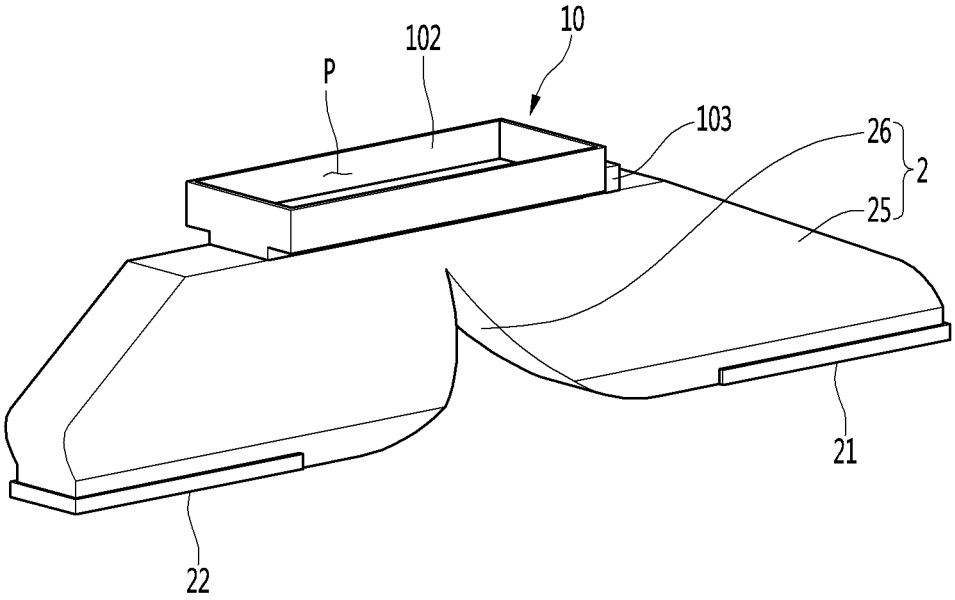
FIG. 3 is a perspective view showing a duct and a damper of the refrigerator according to the embodiment of the present disclosure.
Figure 4:
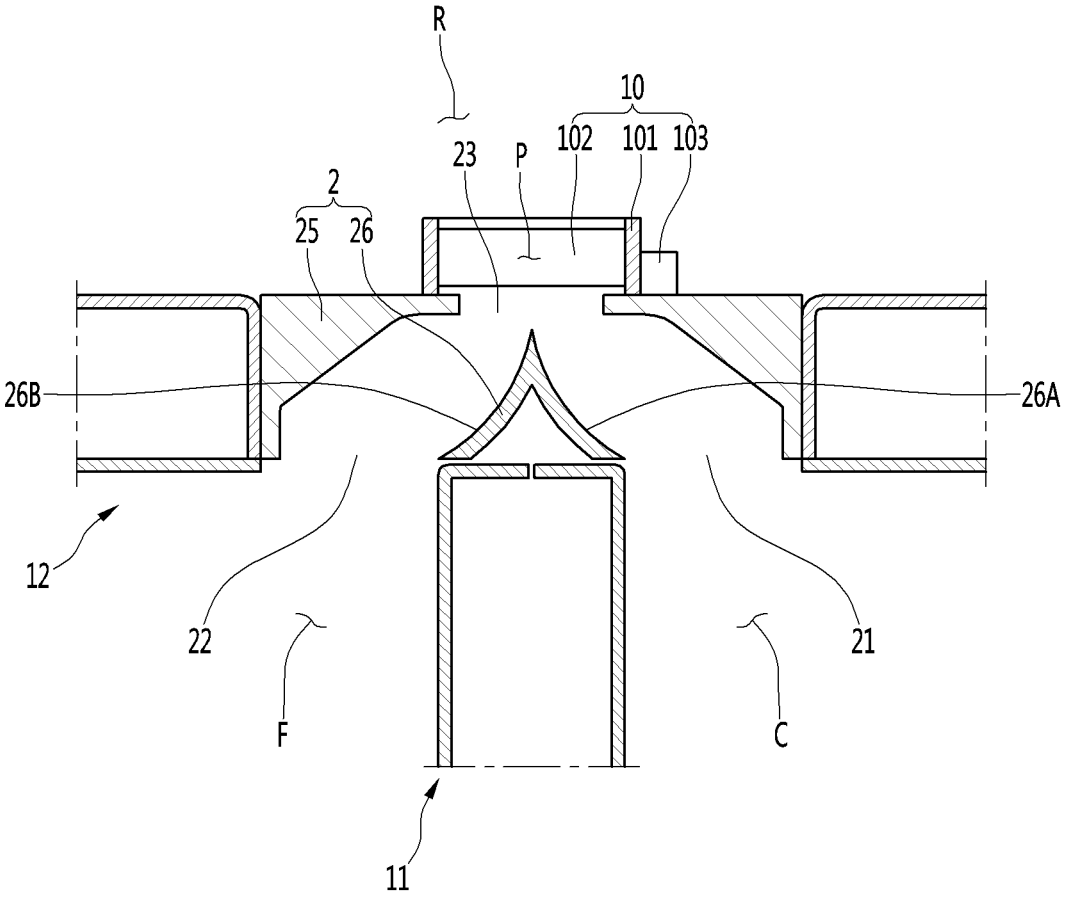
FIG. 4 is a view showing the duct and the damper when the damper of the refrigerator according to the embodiment of the present disclosure is opened.
Figure 5:
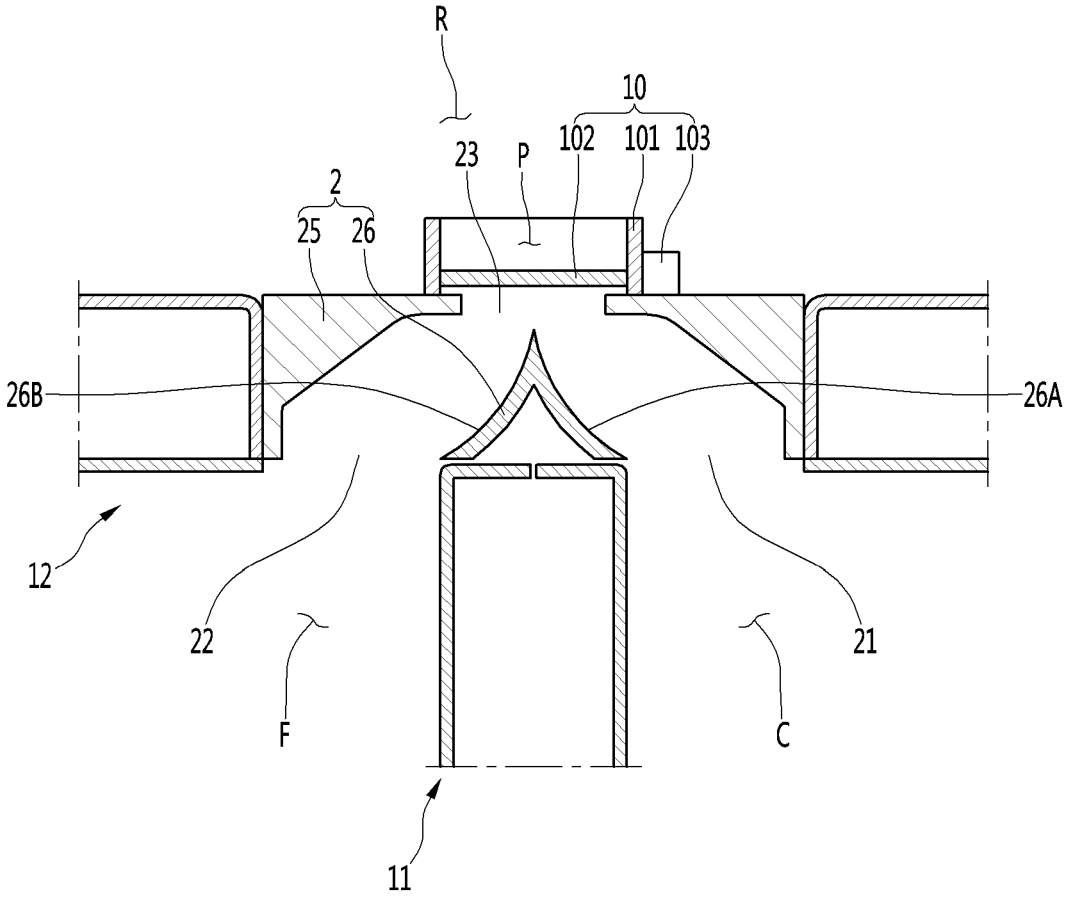
FIG. 5 is a view showing the duct and the damper when the damper of the refrigerator according to the embodiment of the present disclosure is closed.

FIG. 1 is a diagram showing a configuration of a refrigerator according to an embodiment of the present disclosure, FIG. 2 is a cross-sectional view showing an inside of the refrigerator according to the embodiment of the present disclosure, FIG. 3 is a perspective view showing a duct and a damper of the refrigerator according to the embodiment of the present disclosure, FIG. 4 is a view showing the duct and the damper when the damper of the refrigerator according to the embodiment of the present disclosure is opened, and FIG. 5 is a view showing the duct and the damper when the damper of the refrigerator according to the embodiment of the present disclosure is closed.

The refrigerator of the present embodiment includes a main body 1, a compressor 3, a condenser 4, a plurality of evaporators 5 and 6, a plurality of capillary tubes 7, 8 and 9 and a damper 10.

A plurality of storage chambers C, F and R may be formed in the main body 1. The plurality of storage chambers C, F and R may be partitioned by a plurality of barriers 11 and 12. The plurality of storage chambers C, F and R may include a freezing chamber F, a switchable chamber C and a refrigerating chamber R. The freezing chamber F, the switchable chamber C and the refrigerating chamber R may be partitioned by the plurality of barriers 11 and 12.

A user may operate an operation unit (not shown) to select a temperature range of the switchable chamber C, and the refrigerator may maintain the switchable chamber C at the temperature range selected by the user.

The switchable chamber C may be cooled to a temperature mode selected from among a plurality of temperature modes, the user may select one of the plurality of temperature modes, and the refrigerator may control the temperature of the switchable chamber C to the temperature range of the temperature mode selected by the user.

The temperature range of the switchable chamber C may be equal or similar to that of the refrigerating chamber R, may be equal to or similar to that of the freezing chamber F, or may be a specific temperature range between the temperature range of the refrigerating chamber R and the temperature range of the freezing chamber F.

Examples of the temperature range of the switchable chamber C may include a temperature range when food having a relatively low storage temperature, such as meat, is stored and a temperature range when food having a relatively high storage temperature, such as vegetables, is stored.

The refrigerating chamber R may be larger than each of the freezing chamber F and the switchable chamber C. The freezing chamber F and the switchable chamber C may be formed on the left and right sides of a vertical barrier 11, and the refrigerating chamber R may be formed above or below the freezing chamber F and the switchable chamber C.

The refrigerator may include a horizontal barrier 12 for separating the refrigerating chamber R from the freezing chamber F and the switchable chamber C.

If the refrigerating chamber R is formed at the upper side of the main body 1, the freezing chamber F and the switchable chamber C may be formed below the refrigerating chamber R. In contrast, if the refrigerating chamber R is formed at the lower side of the main body 1, the freezing chamber F and the switchable chamber C may be located above the refrigerating chamber R.

The main body 1 may include a switchable chamber inner case 13 forming the switchable chamber C, and a switchable chamber inner panel 13A in which a suction port and a discharging port are formed, and may be disposed in the switchable chamber inner case 13. The switchable chamber inner panel 13A may be disposed in the switchable chamber inner case 13 to cover a switchable chamber evaporator 5. The main body 1 may be connected with a switchable chamber door 13B for opening or closing the switchable chamber C.

The main body 1 may include a freezing chamber inner case 14 forming the freezing chamber F, and a freezing chamber inner panel 14A in which a suction port and a discharging port are formed, and may be disposed in the freezing chamber inner case 14. The freezing chamber inner panel 14A may be disposed in the freezing chamber inner case 14 to cover a freezing chamber evaporator 6. The main body 1 may be connected with the freezing chamber door 14B for opening or closing the freezing chamber F.

The main body 1 may include a refrigerating chamber inner case 15 forming the refrigerating chamber R, and a refrigerating chamber inner case panel 15A may be disposed in the refrigerating chamber inner case 15. Cold air introduced from a duct 2 may pass through the refrigerating chamber inner panel 15A, and the cold air guided into the refrigerating chamber inner panel 15A may be discharged to the refrigerating chamber. The main body 1 may be connected with at least one refrigerating chamber door 15B for opening or closing the refrigerating chamber R.

The main body 1 may include at least one return duct for guiding the cold air of the refrigerating chamber R to the switchable chamber C or the freezing chamber F. In the case a plurality of return ducts are disposed in the main body 1 a switchable chamber return duct (not shown) for guiding the cold air of the refrigerating chamber R to the switchable chamber C and a freezing chamber return duct (not shown) for guiding the cold air of the refrigerating chamber R to the freezing chamber F may be disposed in the main body 1.

Each of the freezing chamber F and the switchable chamber C may communicate with the refrigerating chamber R by at least one duct 2, and the at least one duct 2 may be a refrigerating chamber cold air supply duct for guiding the cold air of the switchable chamber C or the cold air of the freezing chamber F to the refrigerating chamber R.

For example, each of the freezing chamber F and the switchable chamber C may communicate with the refrigerating chamber R through a plurality of ducts. In this case, the plurality of ducts may include a first duct for allowing the freezing chamber F to communicate with the refrigerating chamber R and a second duct for allowing the switchable chamber C to communicate with the refrigerating chamber R, and the first duct and the second duct may be independently opened or closed.

In another example, the freezing chamber F and the switchable chamber C may communicate with the refrigerating chamber R by one duct 2. In this case, it is possible to minimize the number of parts of the refrigerator.

Hereinafter, an example in which the freezing chamber F and the switchable chamber C may communicate with the refrigerating chamber R with one duct 2 will be described.

However, the present disclosure is not limited to one duct 2 and the freezing chamber F and the refrigerating chamber R may communicate with each other through a first duct and the switchable chamber C and the refrigerating chamber R may communicate with each other through a second duct.

Referring to FIG. 4, the duct 2 may include a switchable chamber conduit 21 communicating with the switchable chamber C, a freezing chamber conduit 22 communicating with the freezing chamber F, and a refrigerating conduit 23 communicating with each of the switchable chamber conduit 21 and the freezing chamber conduit 22 and communicating with the refrigerating chamber R.

The duct 2 may include a duct body 25. The switchable chamber conduit 21, the freezing chamber conduit 22 and the refrigerating chamber conduit 23 may be formed in the duct body 25. The duct body 25 may be disposed in a duct accommodation hole formed in the horizontal barrier 12.

The duct 2 may include a barrier 26 for blocking flow of cold air between the switchable chamber conduit 21 and the freezing chamber conduit 22. The barrier 26 may be formed inside the duct body 25. The barrier 26 may be formed between the switchable chamber conduit 21 and the freezing chamber conduit 22.

The duct 2 may determine the amount of cold air flowing between the switchable chamber C and the freezing chamber F according to a height and shape of the barrier 26. The duct 2 may have a height and shape such that the amount of cold air flowing between the switchable chamber C and the freezing chamber F is not excessively large and may have a shape and height such that each of cold air flowing in the switchable chamber C and cold air flowing in the freezing chamber F are directed to the damper 10 as much as possible.

An upper end of the barrier 26 may face a bottom of the damper 10. The upper end of the barrier 26 may be formed to face a passage P of a path body 101 configuring the damper 10. If the height of the barrier 26 is too high, a possibility of interference between the barrier 26 and the damper 10 may be high, and, if the height of the barrier 26 is too low, the amount of cold air flowing between the switchable chamber C and the freezing chamber F may be excessively large. The barrier 26 may be spaced apart from the refrigerating chamber conduit 23 and under the refrigerating chamber conduit 23 in a vertical direction.

The barrier 26 may include cold air guide surfaces 26A and 26B for guiding cold air. The barrier 26 may have a horizontal width decreasing toward to the top. The cold air guide surfaces 26A and 26B may be formed to become sloped gradually from the bottom and to become steep toward the top.

Both surfaces of the barrier 26 may be the cold air guide surfaces 26A and 26B. Both surfaces 26A and 26*b* of the barrier 26 may be recessed. Both surfaces of the barrier 26 may maximally guide the cold air blown from the switchable chamber C and the freezing chamber F in a vertical direction. In this case, flow of cold air between the switchable chamber C and the freezing chamber F may be minimized.

One surface 26A of the barrier 26 may form the switchable chamber conduit 21, and the surface 26A may be recessed. The cold air of the switchable chamber C may be guided to the surface 26A of the barrier 26 to flow to the refrigerating chamber conduit 23.

The other surface 26B of the barrier 26 may form the freezing chamber conduit 22, and the other surface may be recessed. The cold air of the freezing chamber F may be guided to the other surface 26B of the barrier 26 to flow to the refrigerating chamber conduit 23.

The damper 10 may control flow of cold air through the duct 2.

The damper 10 may be disposed in the refrigerating chamber R or the duct 2. The damper 10 may include a path body 101, a damper body 102 and a driving device 103.

The passage P, through which air passes, may be formed in the path body 101. The damper body 102 may open or close the passage P of the path body 101. The driving device 103 may open or close the damper body 102. The driving device 103 may include a motor and may be connected to the damper body 102 directly or through at least one power transmitting member.

The path body 101 may be disposed in one of the refrigerating chamber R or the duct 2, and the damper body 102 may be rotatably connected to the path body 101, and the driving device 103 may be mounted to the path body 101 to rotate the damper body 102.

In the damper 10, the damper body 102 may be rotatably disposed in a refrigerating chamber inner case 15 or the duct 2 without a separate path body, and the driving device 103 may be mounted to the refrigerating chamber inner case 15 or the duct 2 to rotate the damper body 102.

In the open mode of the damper 10, as shown in FIG. 4, the damper body 102 may rotate in a direction for opening the passage 2 of the duct 2, and the cold air of the switchable chamber C or the cold air of the freezing chamber F may flow to the refrigerating chamber R through the duct 2.

In the open mode of the damper 10, the cold air of the switchable chamber C may flow into the switchable chamber conduit 21, pass through the refrigerating chamber conduit 23, and then pass through the damper 10. In addition, the cold air of the freezing chamber F may flow into the freezing chamber conduit 22, pass through the refrigerating chamber conduit 23 and then pass through the damper 10.

In the close mode of the damper 10, as shown in FIG. 5, the damper body 102 may rotate in a direction for closing the passage P of the duct 2. The cold air of the switchable chamber C and the cold air of the freezing chamber F are blocked by the damper 10 so as not to flow to the refrigerating chamber R.

The damper 10 may control the opening area of the passage P in multiple stages. In this case, the flow rate of cold air flowing from one of the switchable chamber C and the freezing chamber F to the refrigerating chamber R may be more precisely controlled.

The compressor 3 compresses refrigerant. The compressor 3 may be connected to a compressor suction path 31 and a compressor discharging path 32, and the compressor 3 may suck and compress the refrigerant of the compressor suction path 31 and then discharge the refrigerant to the compressor discharging path 32.

The condenser 4 condenses the refrigerant compressed in the compressor 3 and may be connected with the compressor discharging path 32. In addition, the condenser 4 may be connected with a condenser discharging path 42. The refrigerant of the compressor discharging path 32 may flow to the condenser 4 to be condensed while passing through the condenser 4, and the refrigerant, which has passed through the condenser 4, may be discharged through the condenser discharging path 42. The refrigerator may further include a condensing fan 44 for blowing air to the condenser 4. The condensing fan 44 may blow outside air of the refrigerator to the condenser 4.

The number of evaporators 5 and 6 may be less than the number of storage chambers formed in the main body 1. The plurality of evaporators 5 and 6 may be provided to respectively cool the storage chambers C and F.

The plurality of evaporators 5 and 6 may include a switchable chamber evaporator 5 for cooling the switchable chamber C and a freezing chamber evaporator 6 for cooling the freezing chamber F.

The switchable chamber evaporator 5 and the freezing chamber evaporator 6 may be connected in series. The switchable chamber evaporator 5 and the freezing chamber evaporator 6 may be connected through an evaporator connection path 55.

Refrigerant may pass through any one of the switchable chamber evaporator 5 and the freezing chamber evaporator 6, pass through the evaporator connection path 55 and pass through the other of the switchable chamber evaporator 5 and the freezing chamber evaporator 6.

The switchable chamber evaporator 5 may be located at an upstream side of the freezing chamber evaporator 6 in a refrigerant flow direction. In addition, the switchable chamber evaporator 5 may be connected with a pair of switchable chamber capillary tubes 7 and 8 by a joint path 51.

The joint path 51 may include a first path 52 connected to the first capillary tube 7 of the pair of switchable chamber capillary tubes 7 and 8, a second path 53 connected to the second capillary tube 8 of the pair of switchable chamber capillary tubes 7 and 8, and a common path 54 connected with the first path 52 and the second path 53. The common path 54 may be connected to the switchable chamber evaporator 5.

The refrigerator may further include a switchable chamber fan 56 for enabling the cold air of the switchable chamber C to flow to the switchable chamber evaporator 5 and then blowing the cold air to the switchable chamber C and the duct 2.

The freezing chamber evaporator 6 may be connected to the compressor 3 and the compressor suction path 31. Since the freezing chamber evaporator 6 is connected to the switchable chamber evaporator 5 in series, the freezing chamber evaporator 6 may exchange heat with the refrigerant evaporated while passing through the switchable chamber evaporator 5.

The refrigerator may further include a freezing chamber fan 66 for enabling the cold air of the freezing chamber F to flow to the freezing chamber evaporator 6 and then blowing the cold air to the freezing chamber F and to the duct 2.

The plurality of capillaries 7, 8 and 9 may include a pair of capillary tubes 7 and 8 connected to the switchable chamber evaporator 5 and a bypass capillary tube 9 connected to the evaporator connection path 55.

The refrigerator may include a path switching device 110 for switching the path of the refrigerant condensed in the condenser 4.

The pair of switchable chamber capillary tubes 7 and 8 may be connected to the path switching device 110.

The first capillary tube 7 of the pair of switchable chamber capillary tubes 7 and 8 may be connected to the path switching device 110 through a first inlet path 71, and may be connected to the switchable chamber evaporator 5 through the joint path 51. The first capillary tube 7 may be connected to the joint path 51 and, more particularly, to the first path 52.

The second capillary tube 8 of the pair of switchable chamber capillary tubes 7 and 8 may be connected to the path switching device 110 through a second inlet path 81, and may be connected to the switchable chamber evaporator 5 through the joint path 51. The second capillary tube 8 may be connected to the joint path 51 and, more particularly, to the second path 53.

The pair of switchable chamber capillary tubes 7 and 8 may have the same capacity.

The bypass capillary tube 9 may connect the path switching device 110 with the evaporator connection path 55. The bypass capillary tube 9 may decompress the refrigerant bypassing the switchable chamber evaporator 5 after being condensed in the condenser 4. The bypass capillary tube 9 may be connected to the path switching device 110 through a third inlet path 91. The bypass capillary tube 9 may be connected to the evaporator connection path 55 through an outlet path 92.

The path switching device 110 may be connected to the condenser discharging path 42, the pair of switchable chamber capillary tubes 7 and 8 and the bypass capillary tube 9. The path switching device 110 may guide the refrigerant flowing in the condenser discharging path 42 to the pair of switchable chamber capillary tubes 7 and 8 and the bypass capillary tube 9.

The path switching device 110 may be composed of a single valve or a combination of a plurality of valves. The path switching device 110 of the present embodiment may include one four-way valve. The path switching device 110 may include one inlet port 111 and three outlet ports 112, 113 and 114.

The path switching device 110 may include an inlet port 111 connected with the condenser discharging path 42.

In the path switching device 110, the first outlet port 112 connected to any one of the pair of capillary tubes 7 and 8, the second outlet port 113 connected to the other of the pair of capillary tubes 7 and 8, and the third output port 114 connected to the bypass capillary tube 9 may be formed.

The refrigerator of the present embodiment may be a dual capillary-serial bypass cycle in which the switchable chamber evaporator 5 and the freezing chamber evaporator 6 may be connected in series, the refrigerant may bypass the switchable chamber evaporator 5 to flow to the freezing chamber evaporator 6, and the dual capillaries 7 and 8 may supply a large amount of refrigerant to the switchable chamber evaporator 5.

The refrigerator of the present embodiment may control the temperatures of the three storage chambers C, F and R using one compressor 3, two evaporators 5 and 6, three capillary tubes 7, 8 and 9, two fans 56 and 66, the duct 2 and the damper 10.

Meanwhile, the refrigerator may include the same configuration as the embodiment of the present disclosure described immediately above, but one capillary tube is connected to the switchable chamber evaporator 5, instead of the pair of switchable chamber capillary tubes 7 and 8. However, in this case, since the refrigerant first passes through the switchable chamber evaporator 5 and then passes through the freezing chamber evaporator 6, the cooling capacity of the refrigerant may be significantly lost in the switchable chamber evaporator 5. The refrigerant having a relatively higher temperature than the switchable chamber evaporator 5 may flow into the freezing chamber evaporator 6, and the temperature of the freezing chamber F may slowly decrease. In addition, in a state in which the freezing chamber F is not sufficiently and rapidly cooled, the cold air of the freezing chamber F may flow into the refrigerating chamber R, such that the refrigerating chamber R may not be rapidly cooled.

In contrast, in the present embodiment, the refrigerator having the pair of capillary tubes 7 and 8 may supply a large amount of refrigerant through the pair of switchable chamber capillary tubes 7 and 8. When the refrigerator starts up or copes with a high load, the switchable chamber evaporator 5 may be rapidly cooled and sufficient cooling capacity may be provided to the freezing chamber evaporator 6.

Meanwhile, the present invention does not limit the number of switchable chamber capillary tubes.

Figure 6:
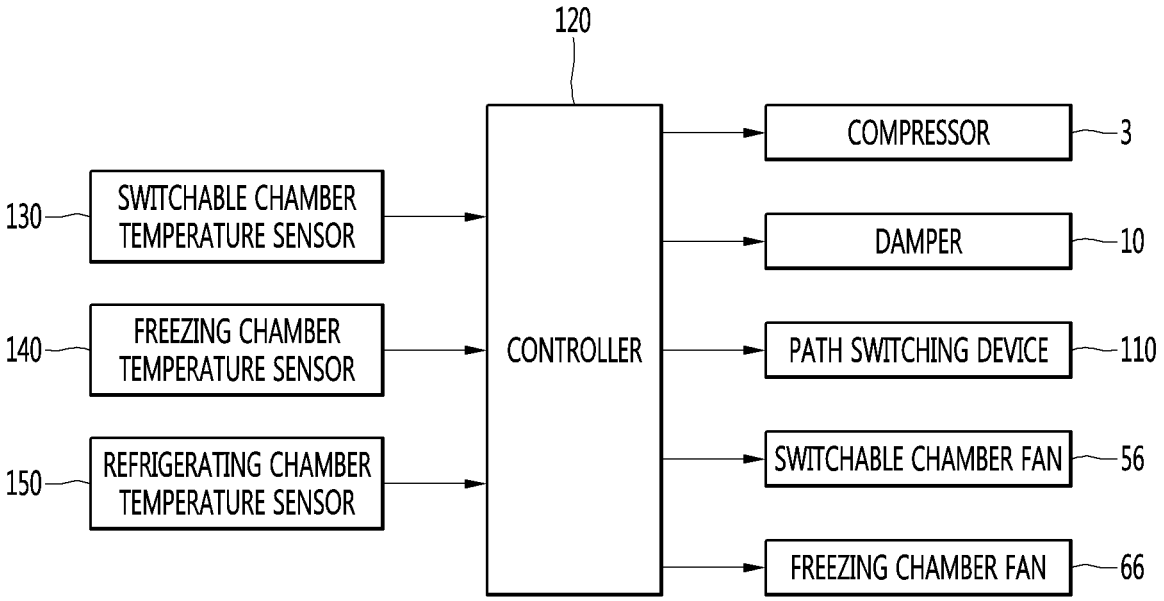
FIG. 6 is a control block diagram of the refrigerator according to the embodiment of the present disclosure.
Figure 7:
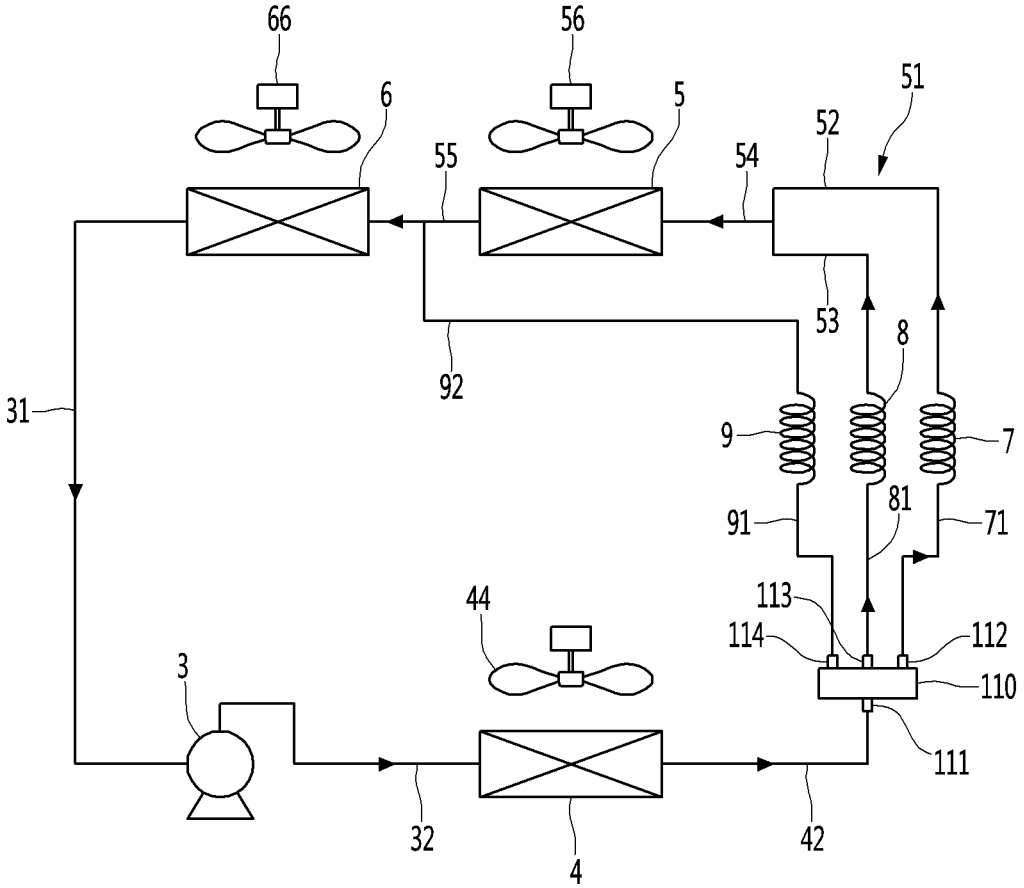
FIG. 7 is a view showing flow of refrigerant when a switchable chamber evaporator and a freezing chamber evaporator are in a serial mode in the refrigerator according to the embodiment of the present disclosure.
Figure 8:
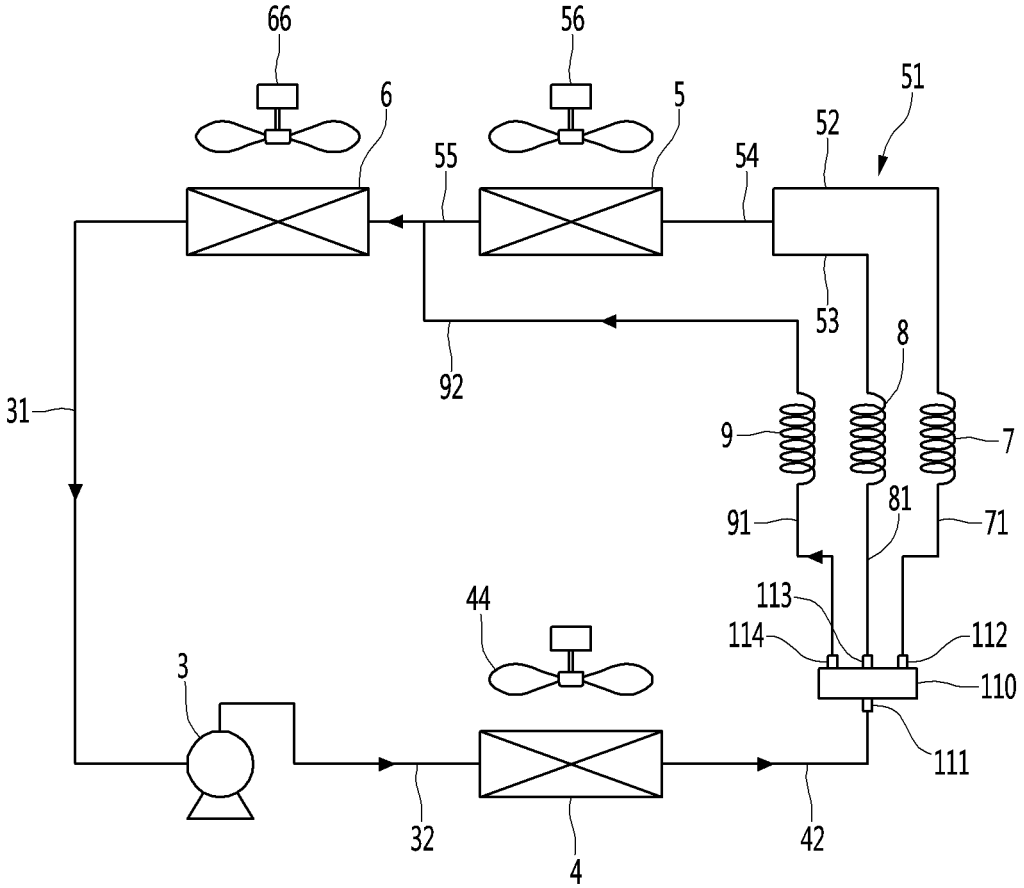
FIG. 8 is a view showing flow of refrigerant when the refrigerator according to the embodiment of the present disclosure is in a freezing chamber mode in which refrigerant is supplied only to a freezing chamber evaporator.

FIG. 6 is a control block diagram of the refrigerator according to the embodiment of the present disclosure, FIG. 7 is a view showing flow of refrigerant when a switchable chamber evaporator and a freezing chamber evaporator are in a serial mode in the refrigerator according to the embodiment of the present disclosure, FIG. 8 is a view showing flow of refrigerant when the refrigerator according to the embodiment of the present disclosure is in a freezing chamber mode in which refrigerant is supplied only to a freezing chamber evaporator.

The refrigerator may include a controller 120 for controlling the damper 10. The controller 120 may be an electronic circuit including a microprocessor, an electronic logical circuit, or a custom integrated circuit. In addition, the refrigerator may further include a switchable chamber temperature sensor 130 for sensing the temperature of the switchable chamber, a freezing chamber temperature sensor 140 for sensing the temperature of the freezing chamber, and a refrigerating chamber temperature sensor 150 for sensing the temperature of the refrigerating chamber.

The controller 120 may control the damper 10 according to the temperature of the refrigerating chamber sensed by the refrigerating chamber temperature sensor 150.

The controller 120 may close the damper 10 if the temperature of the refrigerating chamber is satisfied, and open the damper 10 if the temperature of the refrigerating chamber is dissatisfied.

According to the present embodiment, satisfaction of the temperature of the refrigerating chamber may correspond to the case where the temperature of the refrigerating chamber decreases to a lower-limit temperature (target temperature −1° C.) of a target temperature of the refrigerating chamber. The controller 120 may close the damper 10 when the temperature of the refrigerating chamber decreases to the lower-limit temperature of the target temperature of the refrigerating chamber.

Dissatisfaction of the temperature of the refrigerating chamber may correspond to the case where the temperature of the refrigerating chamber increases to an upper-limit temperature (target temperature+1° C.) of the target temperature of the refrigerating chamber. The controller 120 may open the damper 10 when the temperature of the refrigerating chamber increases to the upper-limit temperature of the target temperature of the refrigerating chamber.

The controller 120 may control the compressor 3 and the path switching device 110.

The controller 120 may control the path switching device 110 to one of a plurality of modes.

The plurality of modes may include a serial mode in which the path switching device 110 guides refrigerant to the switchable chamber capillary tubes 7 and 8. The serial mode may be a mode in which the refrigerant is not guided to the bypass capillary tube 9 and is guided to the switchable chamber capillary tubes 7 and 8, as shown in FIG. 7.

When the temperature of the switchable chamber is dissatisfied, the controller 120 may perform the serial mode.

Satisfaction of the temperature of the switchable chamber may correspond to the case where the temperature of the switchable chamber decreases to a lower-limit temperature (target temperature −1° C.) of a target temperature of the switchable chamber.

Dissatisfaction of the temperature of the switchable chamber may correspond to the case where the temperature of the switchable chamber increases to an upper-limit temperature (target temperature+1° C.) of the target temperature of the switchable chamber.

When the path switching device 110 is in the serial mode and the compressor 3 is driven, the compressor 3 may compress and discharge refrigerant, and the refrigerant compressed in the compressor 3 may pass through the condenser 4 and then pass through the path switching device 110, flow into the switchable chamber capillary tubes 7 and 8 by the path switching device 110, and pass through the switchable chamber evaporator 5. In this case, the refrigerant, which has passed through the switchable chamber evaporator 5, is sucked into the compressor 3 after passing through the freezing chamber evaporator 6.

Meanwhile, the plurality of modes may include a freezing chamber mode in which the path switching device 110 guides refrigerant to the bypass capillary tube 9. The freezing chamber mode may be a mode in which refrigerant is not guided to the switchable chamber capillary tubes 7 and 8 and is guided only to the bypass capillary tube 9, as shown in FIG. 8.

freezing chamber increases to an upper-limit temperature (target temperature+1° C.) of the target temperature of the freezing chamber.

The controller 120 may control the switchable chamber fan 56 and the freezing chamber fan 66. The controller 120 may change the speeds of the switchable chamber fan 56 and the freezing chamber fan 66 according to the values sensed by the switchable chamber temperature sensor 130, the freezing chamber temperature sensor 140 and the refrigerating chamber temperature sensor 150. The speed of each of the switchable chamber fan 56 and the freezing chamber fan 66 may be changed to a low speed L, a middle speed M and a high speed H.

The controller 120 may differently control the rotational speed, i.e., revolutions per minute (rpm) of each of the switchable chamber fan 56 and the freezing chamber fan 66 according to the target temperature of the switchable chamber.

Table 1 shows a method of controlling the switchable chamber fan 56, the freezing chamber fan 66, the path switching device 110 and the damper 10 according to satisfaction/dissatisfaction of the refrigerating chamber temperature, satisfaction/dissatisfaction of the switchable chamber temperature and satisfaction/dissatisfaction of the freezing chamber temperature when the target temperature of the switchable chamber exceeds the set temperature.

TABLE 1

| Example | Refrigerating chamber temperature | Switchable chamber temperature | Freezing chamber temperature | Freezing chamber fan wind speed | Switchable chamber fan wind speed | Path switching device mode | Damper mode |
|---|---|---|---|---|---|---|---|
| First example | dissatisfaction | dissatisfaction | dissatisfaction | L | H | Serial mode | open |
| Second example | dissatisfaction | satisfaction | satisfaction | H | L | Close | open |
| Third example | dissatisfaction | dissatisfaction | satisfaction | L | H | Serial mode | open |
| Fourth example | dissatisfaction | satisfaction | dissatisfaction | H | L | Freezing chamber mode | open |
| Fifth example | satisfaction | satisfaction | dissatisfaction | M | stop | Freezing chamber mode | close |
| Sixth example | satisfaction | dissatisfaction | satisfaction | stop | M | Serial mode | close |
| Seventh example | satisfaction | dissatisfaction | dissatisfaction | M | M | Serial mode | close |
| Eighth example | satisfaction | satisfaction | satisfaction | stop | stop | close | close |

When the path switching device 110 is in the freezing chamber mode and the compressor 3 is driven, the compressor may compress and discharge refrigerant, and the refrigerant compressed in the compressor 3 may pass through the condenser 4 and then pass through the path switching device 110, thereby being guided only to the bypass capillary tube 9 by the path switching device 110. The refrigerant, which has passed through the bypass capillary tube 9, pass through the freezing chamber evaporator 6, and thereby being sucked into the compressor 3.

The freezing chamber mode may be performed when the temperature of the switchable chamber is satisfied and the temperature of the freezing chamber is dissatisfied.

Satisfaction of the temperature of the freezing chamber may correspond to the case where the temperature of the freezing chamber decreases to a lower-limit temperature (target temperature−1° C.) of a target temperature of the freezing chamber.

Dissatisfaction of the temperature of the freezing chamber may correspond to the case where the temperature of the The controller 120 may differently control the rotational speed of each of the switchable chamber fan 56 and the freezing chamber fan 66 when the target temperature of the switchable chamber exceeds the set temperature (e.g., −13° C.) and a specific condition is satisfied.

Here, the set temperature may be a temperature higher than a maximum target temperature (e.g., −16° C.) among the target temperatures (−16° C. to −24° C.) of the freezing chamber.

The specific condition may be the case where the temperature of the refrigerating chamber is dissatisfied when the target temperature of the switchable chamber exceeding the set temperature (e.g., −13° C.) is selected.

In the first to fourth examples of Table 1, the target temperature of the switchable chamber exceeds the set temperature (e.g., −13° C.) and the temperature of the refrigerating chamber is dissatisfied. In this case, the controller 120 may open the damper 10 regardless of satisfaction/dissatisfaction of the temperature of the switchable chamber and satisfaction/dissatisfaction of the temperature of the freezing chamber. In addition, the controller 120 may drive both the switchable chamber fan 56 and the freezing chamber fan 66 regardless of satisfaction/dissatisfaction of the temperature of the switchable chamber and satisfaction/dissatisfaction of the temperature of the freezing chamber, and may differently control the rotational speed of each of the switchable chamber fan 56 and the freezing chamber fan 66.

The case where the target temperature of the switchable chamber exceeds the set temperature (e.g., −13° C.) and the temperature of the refrigerating chamber is dissatisfied (that is, the first to fourth examples of Table 1) corresponds to the case where the temperature of the refrigerating chamber is dissatisfied when the user sets the target temperature of the switchable chamber relatively high. In this case, the controller 120 may cool the freezing chamber F prior to the switchable chamber C while the switchable chamber C and the freezing chamber F cool the refrigerating chamber R.

First, the first example will be described in detail.

Figure 9:
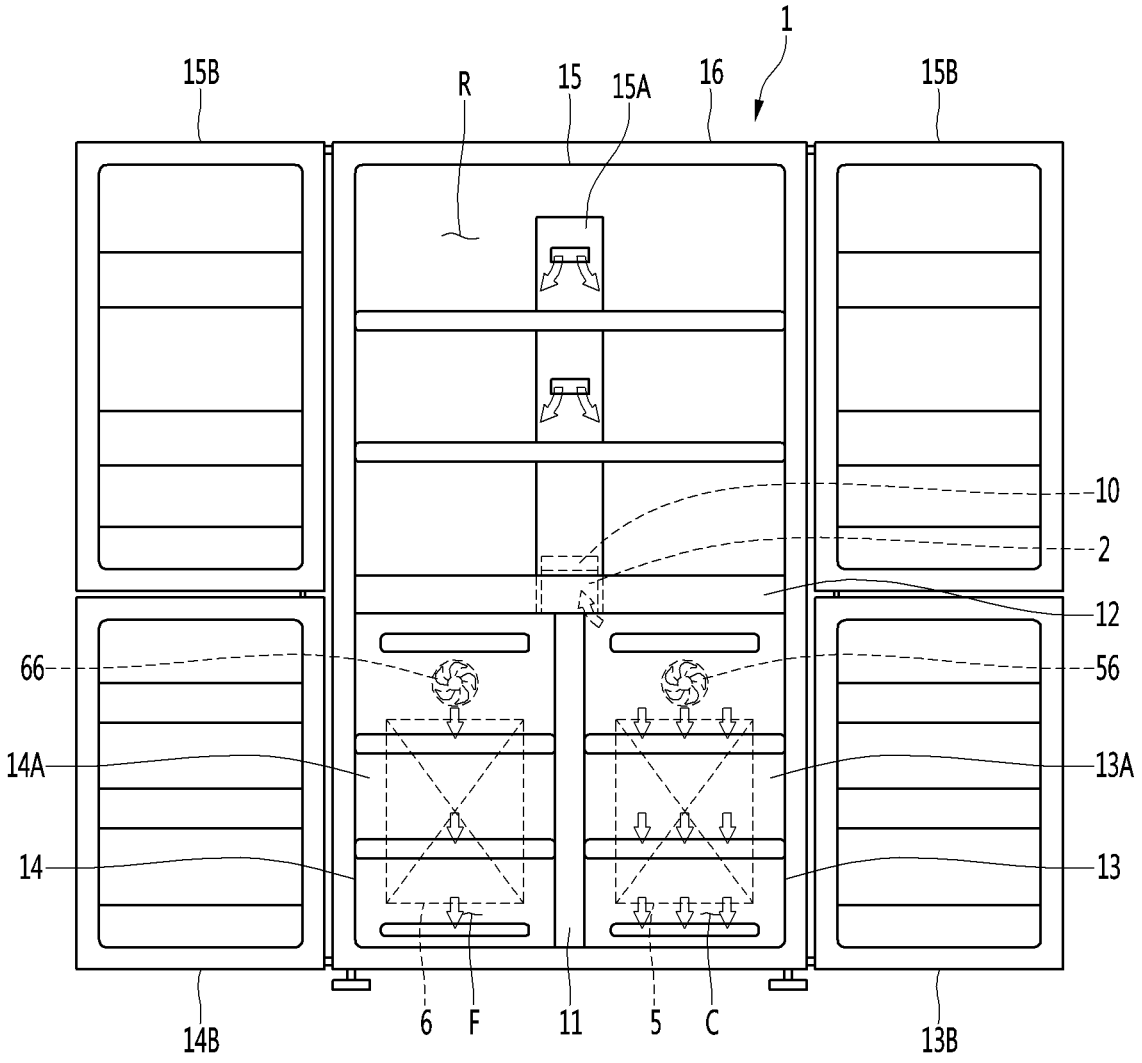
FIG. 9 is a view showing flow of cold air when a target temperature of a switchable chamber exceeds a set temperature, a temperature of a refrigerating chamber is dissatisfied and temperatures of the switchable chamber and the freezing chamber are dissatisfied in the refrigerator according to the embodiment of the present disclosure.

FIG. 9 is a view showing flow of cold air when the target temperature of a switchable chamber exceeds the set temperature, the temperature of a refrigerating chamber is dissatisfied and the temperatures of the switchable chamber and the freezing chamber are dissatisfied in the refrigerator according to the embodiment of the present disclosure.

The controller 120 may control the path switching device 110 to the serial mode and rotate the switchable chamber fan 56 at a higher rotational speed than the freezing chamber fan 66, when the target temperature of the switchable chamber exceeds the set temperature (e.g., −13° C.), the temperature of a refrigerating chamber is dissatisfied, the temperature of the switchable chamber is dissatisfied and the temperature of the freezing chamber is dissatisfied like the first example of Table 1. The controller 120 may rotate the switchable chamber fan 56 at the high speed H, and rotate the freezing chamber fan 66 at the low speed L.

If the path switching device 110 is in the serial mode, the path switching device 110 may guide refrigerant to the switchable chamber evaporator 5, the refrigerant may pass through the switchable chamber evaporator 5 and then pass through the freezing chamber evaporator 6, and the refrigerant may be sucked into the compressor 3 after cooling both the switchable chamber C and the freezing chamber F.

The switchable chamber fan 56 rotates at the high speed H such that the cold air of the switchable chamber C flows to the switchable chamber evaporator 5, and the switchable chamber fan 56 may blow the cold air exchanging heat with the switchable chamber evaporator 5 to the switchable chamber C and the refrigerating chamber R.

Meanwhile, the freezing chamber fan 66 rotates at the low speed L such that the cold air of the freezing chamber F flows to the freezing chamber evaporator 6, and the freezing chamber fan 66 may blow the cold air exchanging heat with the freezing chamber evaporator 6 to the freezing chamber F and the refrigerating chamber R, and the cold air of the freezing chamber F may be used to cool the refrigerating chamber R.

In the first example, the refrigerator may simultaneously cool the refrigerating chamber R, the switchable chamber C and the freezing chamber F. In addition, since the switchable chamber fan 56 rotates at a higher speed than the freezing chamber fan 66, cold air exchanging heat with the switchable chamber evaporator 5 may mainly flow into the refrigerating chamber R from the switchable chamber C, and the refrigerating chamber R and the switchable chamber C may be rapidly cooled.

An example in which the temperature of the refrigerating chamber, the temperature of the switchable chamber and the temperature of the freezing chamber are all dissatisfied may include a case where the power of the refrigerator is switched from OFF to ON, such as a case where the refrigerator starts up. In this case, the refrigerator may rapidly cool the refrigerating chamber R and the switchable chamber C prior to the freezing chamber F.

Hereinafter, the second example will be described in detail.

Figure 10:
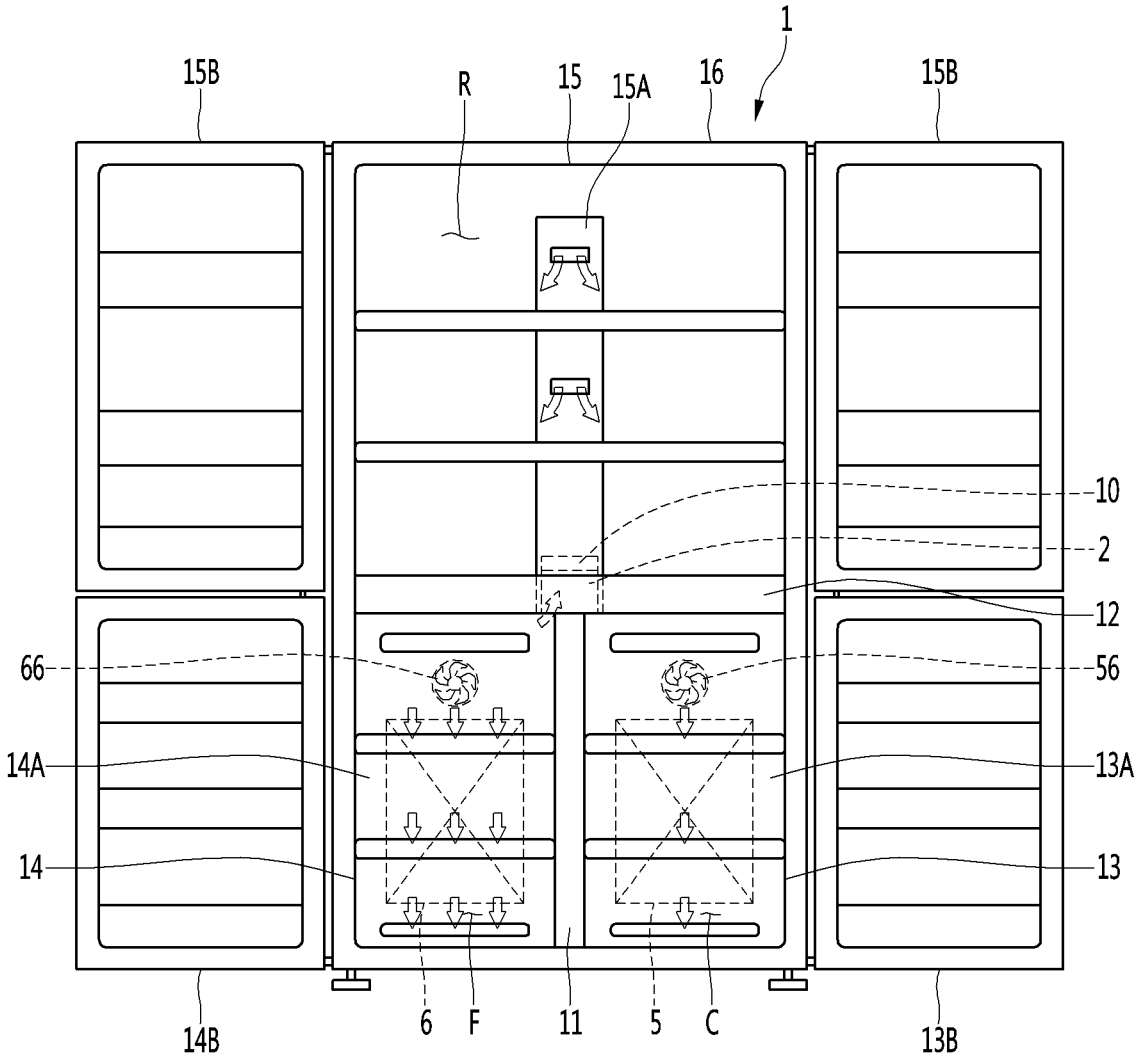
FIG. 10 is a view showing flow of cold air when a target temperature of a switchable chamber exceeds a set temperature, a temperature of a refrigerating chamber is dissatisfied and temperatures of the switchable chamber and the freezing chamber are satisfied in the refrigerator according to the embodiment of the present disclosure.

FIG. 10 is a view showing flow of cold air when the target temperature of a switchable chamber exceeds the set temperature, the temperature of a refrigerating chamber is dissatisfied and the temperatures of the switchable chamber and the freezing chamber are satisfied in the refrigerator according to the embodiment of the present disclosure.

The controller 120 may close the path switching device 110 and rotate the freezing chamber fan 66 at a higher speed than the switchable chamber fan 56, when the target temperature of the switchable chamber exceeds the set temperature (e.g., −13° C.), the temperature of a refrigerating chamber is dissatisfied, the temperature of the switchable chamber is satisfied and the temperature of the freezing chamber is satisfied like the second example of Table 1. The controller 120 may rotate the freezing chamber fan 66 at the high speed H, and rotate the switchable chamber fan 56 at the low speed L.

If the path switching device 110 is in a close mode, the compressor 3 may be in an OFF state and the path switching device 110 may not guide refrigerant to the switchable chamber evaporator 5 and the freezing chamber evaporator 6.

The switchable chamber fan 56 may rotate at the low speed L such that the cold air of the switchable chamber C flows to the switchable chamber evaporator 5, the switchable chamber fan 56 may blow the cold air exchanging heat with the switchable chamber evaporator 5 to the switchable chamber C and the refrigerating chamber R, and the cold air of the switchable chamber C may be used to cool the refrigerating chamber R.

Meanwhile, the freezing chamber fan 66 may rotate at the high speed H, such that the cold air of the freezing chamber F flows to the freezing chamber evaporator 6, and the freezing chamber fan 66 may blow the cold air exchanging heat with the freezing chamber evaporator 6 to the freezing chamber F and the refrigerating chamber R, and the cold air of the freezing chamber F may be used to cool the refrigerating chamber R.

In the second example, the refrigerator may cool the refrigerating chamber R using the cold air of the switchable chamber C and the cold air of the freezing chamber F. Since the freezing chamber fan 66 rotates at a higher speed than the switchable chamber fan 56, the cold air of the freezing chamber F may mainly flow into the refrigerating chamber R.

The cold air of the freezing chamber F is the colder air than the cold air of the switchable chamber C and the colder air of the freezing chamber F may mainly flow into the refrigerating chamber R, and the refrigerating chamber R may be more rapidly cooled as compared to the case where the cold air of the switchable chamber C flows into the refrigerating chamber R. Meanwhile, the amount of cold air supplied by the switchable chamber C is less than the amount of cold air supplied by the freezing chamber F, and rapid rise in temperature of the switchable chamber C may be minimized.

Hereinafter, the third example will be described.

The controller 120 may control the path switching device 110 to the serial mode and rotate the switchable chamber fan 56 at a higher speed than the freezing chamber fan 66, when the target temperature of the switchable chamber exceeds the set temperature, the temperature of a refrigerating chamber is dissatisfied, the temperature of the switchable chamber is dissatisfied and the temperature of the freezing chamber is satisfied like the third example of Table 1. The controller 120 may rotate the switchable chamber fan 56 at the high speed H, and rotate the freezing chamber fan 66 at the low speed L.

The third example is equal to the first example regarding the switchable chamber fan 56, the freezing chamber fan 66, the path switching device 110 and the damper 10. In this case, since the switchable chamber fan 56 rotates at a higher speed than the freezing chamber fan 66, cold air exchanging heat with the switchable chamber evaporator 5 may mainly flow into the refrigerating chamber R, and the refrigerating chamber R and the switchable chamber C may be rapidly cooled.

Hereinafter, the fourth example will be described.

The controller 120 may control the path switching device 110 to the freezing chamber mode and rotate the freezing chamber fan 66 at a higher speed than the switchable chamber fan 56, when the target temperature of the switchable chamber exceeds the set temperature, the temperature of a refrigerating chamber is dissatisfied, the temperature of the switchable chamber is satisfied and the temperature of the freezing chamber is dissatisfied like the fourth example of Table 1. The controller 120 may rotate the freezing chamber fan 66 at the high speed H, and rotate the switchable chamber fan 56 at the low speed L.

When the path switching device 110 is in the freezing chamber mode, the path switching device 110 may not guide refrigerant to the switchable chamber evaporator 5 and may guide refrigerant to the freezing chamber evaporator 6, and the refrigerant may be sucked into the compressor 3 after bypassing the switchable chamber evaporator 5 and passing through the freezing chamber evaporator 6.

The switchable chamber fan 56 rotates at the low speed L such that the cold air of the switchable chamber C flows to the switchable chamber evaporator 5, the switchable chamber fan 56 may blow the cold air exchanging heat with the switchable chamber evaporator 5 to the switchable chamber C and the refrigerating chamber R, and the cold air of the switchable chamber C may be used to cool the refrigerating chamber R.

Meanwhile, the freezing chamber fan 66 rotates at the high speed H such that the cold air of the freezing chamber F flows to the freezing chamber evaporator 6, and the freezing chamber fan 66 may blow the cold air exchanging heat with the freezing chamber evaporator 6 to the freezing chamber F and the refrigerating chamber R, and the cold air of the freezing chamber F may be used to cool the refrigerating chamber R.

In the fourth example, like the second example, the refrigerator may cool the refrigerating chamber R using the cold air the switchable chamber C and the cold air of the freezing chamber F. In addition, since the freezing chamber fan 66 rotates at a higher speed than the switchable chamber fan 56, the cold air of the freezing chamber F may mainly flow into the refrigerating chamber R.

The cold air of the freezing chamber F may mainly flow into the refrigerating chamber R, like the second example, and the refrigerating chamber R may be more rapidly cooled as compared to the case where the cold air of the switchable chamber C flows into the refrigerating chamber. Meanwhile, the amount of cold air supplied by the switchable chamber C is less than the amount of cold air supplied by the freezing chamber F, and rapid rise in temperature of switchable chamber C may be minimized.

In the fifth to eighth examples of Table 1, the target temperature of the switchable chamber exceeds the set temperature (e.g., −13° C.) and the temperature of the refrigerating chamber is satisfied. In this case, the controller 120 may close the damper 10 regardless of satisfaction/dissatisfaction of the temperature of the switchable chamber and satisfaction/dissatisfaction of the temperature of the freezing chamber. In addition, the controller 120 may drive the switchable chamber fan 56 and the freezing chamber fan 66 and the path switching device 110 according to satisfaction/dissatisfaction of the temperature of the switchable chamber and satisfaction/dissatisfaction of the temperature of the freezing chamber, when the temperature of the refrigerating chamber is satisfied.

Hereinafter, the fifth example will be described.

The controller 120 may control the path switching device 110 to the freezing chamber mode, rotate the freezing chamber fan 66 at the middle speed M between the high speed H and the low speed L, and stop the switchable chamber fan 56, when the target temperature of the switchable chamber exceeds the set temperature, the temperature of a refrigerating chamber is satisfied, the temperature of the switchable chamber is satisfied and the temperature of the freezing chamber is dissatisfied like the fifth example of Table 1.

In the path switching device 110 is in the freezing chamber mode, the path switching device 110 may not guide refrigerant to the switchable chamber evaporator 5 and may guide refrigerant to the freezing chamber evaporator 6, and the refrigerant may bypass the switchable chamber evaporator 5 and pass through the freezing chamber evaporator 6, and eventually being sucked into the compressor 3.

Since the refrigerating chamber R is satisfied, the freezing chamber fan 66 may be driven at the middle speed M without being driven at the high speed H. Since the damper 10 is in a close mode, the cold air of the freezing chamber F may flow to the freezing chamber evaporator 6 to exchange heat with the freezing chamber evaporator 6, thereby being concentratedly discharged in the freezing chamber F. The refrigerator may concentratedly cool the freezing chamber F.

Hereinafter, the sixth example will be described.

The controller 120 may control the path switching device 110 to the serial mode, rotate the switchable chamber fan 56 at the middle speed M between the high speed H and the low speed L, and stop the freezing chamber fan 66, when the target temperature of the switchable chamber exceeds the set temperature, the temperature of a refrigerating chamber is satisfied, the temperature of the switchable chamber is dissatisfied and the temperature of the freezing chamber is satisfied like the sixth example of Table 1.

If the path switching device 110 is in the serial mode, the path switching device 110 may guide refrigerant to the switchable chamber evaporator 5, the refrigerant may pass through the switchable chamber evaporator 5 and then pass through the freezing chamber evaporator 6, and the refrigerant may be sucked into the compressor 3 after cooling the switchable chamber C and the freezing chamber F.

Since the refrigerating chamber R is satisfied, the switchable chamber fan 56 may be driven at the middle speed M without being driven at the high speed H. Since the damper 10 is in a close mode, the cold air of the switchable chamber C may flow to the switchable chamber evaporator 5 to exchange heat with the switchable chamber evaporator 5, thereby being concentratedly discharged in the switchable chamber C. The refrigerator may concentratedly cool the switchable chamber C.

Hereinafter, the seventh example will be described.

The controller 120 may control the path switching device 110 to the serial mode and rotate the switchable chamber fan 56 and the freezing chamber fan 66 at the middle speed M between the high speed H and the low speed L, when the target temperature of the switchable chamber exceeds the set temperature, the temperature of a refrigerating chamber is satisfied, the temperature of the switchable chamber is dissatisfied and the temperature of the freezing chamber is dissatisfied like the seventh example of Table 1.

The path switching device 110 may guide refrigerant to the switchable chamber evaporator 5, the refrigerant may pass through the switchable chamber evaporator 5 and then pass through the freezing chamber evaporator 6, and the refrigerant may be sucked into the compressor 3 after cooling the switchable chamber C and the freezing chamber F.

Since the refrigerating chamber R is satisfied, the switchable chamber fan 56 and the freezing chamber fan 66 may be driven at the middle speed M without being driven at the high speed H. Since the damper 10 is in a close mode, the cold air of the switchable chamber C may cool the switchable chamber C while being circulated in the switchable chamber evaporator 5 and the switchable chamber C, and the cold air of the freezing chamber F may cool the freezing chamber F while being circulated in the freezing chamber evaporator 6 and the freezing chamber F. In the seventh example, the cold air of the switchable chamber C and the cold air of the freezing chamber F may independently cool the switchable chamber C and the freezing chamber F.

Hereinafter, the eighth example will be described.

The controller 120 may close the path switching device 110 and stop the switchable chamber fan 56 and the freezing chamber fan 66, when the target temperature of the switchable chamber exceeds the set temperature, the temperature of a refrigerating chamber is satisfied, the temperature of the switchable chamber is satisfied and the temperature of the freezing chamber is satisfied like the eighth example of Table 1.

If the temperature of the refrigerating chamber, the temperature of the switchable chamber and the temperature of the freezing chamber are satisfied, the switchable chamber fan 56 and the freezing chamber fan 66 may be stopped, in order to reduce power consumption.

Table 2 shows a method of controlling the switchable chamber fan 56, the freezing chamber fan 66, the path switching device 110 and the damper 10 according to satisfaction/dissatisfaction of the refrigerating chamber temperature, satisfaction/dissatisfaction of the switchable chamber temperature and satisfaction/dissatisfaction of the freezing chamber temperature when the target temperature of the switchable chamber is equal to or less than the set temperature.

TABLE 2

| Example | Refrigerating chamber temperature | Switchable chamber temperature | Freezing chamber temperature | Freezing chamber fan wind speed | Switchable chamber fan wind speed | Path switching device mode | Damper mode |
|---|---|---|---|---|---|---|---|
| Ninth example | dissatisfaction | dissatisfaction | dissatisfaction | M | M | Serial mode | open |
| Tenth example | dissatisfaction | satisfaction | satisfaction | M | M | close | open |
| Eleventh example | dissatisfaction | dissatisfaction | satisfaction | L | H | Serial mode | open |
| Twelfth embodiment | dissatisfaction | satisfaction | dissatisfaction | H | L | Freezing chamber mode | open |
| Thirteenth example | satisfaction | satisfaction | dissatisfaction | M | stop | Freezing chamber mode | close |
| Fourteenth example | satisfaction | dissatisfaction | satisfaction | stop | M | Serial mode | close |
| Fifteenth example | satisfaction | dissatisfaction | dissatisfaction | M | M | Serial mode | close |
| Sixteenth example | satisfaction | satisfaction | satisfaction | stop | stop | close | close |

Hereinafter, the ninth example will be described.

The controller 120 may control the path switching device 110 to the serial mode and rotate the switchable chamber fan 56 and the freezing chamber fan 66 at the middle speed M, when the target temperature of the switchable chamber is equal to or less than the set temperature, the temperature of a refrigerating chamber is dissatisfied, the temperature of the switchable chamber is dissatisfied and the temperature of the freezing chamber is dissatisfied like the ninth example.

The ninth example is equal to the first example except that the switchable chamber fan 56 and the freezing chamber fan 66 rotate at the middle speed M, and thus a detailed description thereof will be omitted.

If the target temperature of the switchable chamber is equal to or less than the set temperature, the target temperature of the switchable chamber may be equal or similar to the target temperature of the freezing chamber. In this case, since the temperature difference between the switchable chamber C and the freezing chamber F is not large, even when the switchable chamber fan 56 and the freezing chamber fan 66 rotate at the middle speed M, unbalance of cold air supply does not occur, and the refrigerating chamber R may be cooled as the cold air of the switchable chamber C and the cold air of the freezing chamber F are supplied to the refrigerating chamber R.

Hereinafter, the tenth example will be described.

The controller 120 may close the path switching device 110 and rotate the switchable chamber fan 56 and the freezing chamber fan 66 at the middle speed M, when the target temperature of the switchable chamber is equal to or less than the set temperature, the temperature of a refrigerating chamber is dissatisfied, the temperature of the switchable chamber is satisfied and the temperature of the freezing chamber is satisfied like the tenth example.

The ninth example is equal to the second example except that the switchable chamber fan 56 and the freezing chamber fan 66 rotate at the middle speed M, and thus a detailed description thereof will be omitted.

In the tenth example, like the ninth example, the switchable chamber fan 56 and the freezing chamber fan 66 may rotate at the middle speed M, and the refrigerating chamber R may be cooled as the cold air of the switchable chamber C and the cold air of the freezing chamber F are supplied to the refrigerating chamber R.

The eleventh to sixteenth examples shown in Table 2 may perform the same control processes as the third to eighth examples shown in Table 1 regardless of the target temperature of the switchable chamber. That is, the eleventh example may perform the same control process as the third example even when the target temperature of the switchable chamber is equal to or less than the set temperature, the twelfth example may perform the same control process as the fourth example even when the target temperature of the switchable chamber is equal to or less than the set temperature, the thirteenth example may perform the same control process as the fifth example even when the target temperature of the switchable chamber is equal to or less than the set temperature, the fourteenth example may perform the same control process as the sixth example even when the target temperature of the switchable chamber is equal to or less than the set temperature, the fifth example may perform the same control process as the seventh example even when the target temperature of the switchable chamber is equal to or less than the set temperature, and the sixteen example may perform the same control process as the eighth example even when the target temperature of the switchable chamber is equal to or less than the set temperature.

According to the embodiments of the present disclosure, it is possible to more rapidly cool the refrigerating chamber while minimizing back flow of cold air between the freezing chamber and the switchable chamber generated when a difference between the target temperature of the freezing chamber and the target temperature of the switchable chamber is large.

The above-disclosed subject matter is to be considered illustrative, and not restrictive, and the appended claims are intended to cover all such modifications, enhancements, and other embodiments, which fall within the scope of the present disclosure.

Thus, the embodiment of the present disclosure is to be considered illustrative, and not restrictive.

Therefore, the scope of the appended claims is defined not by the detailed description of the invention but by the appended claims, and all differences within the scope will be construed as being included in the appended claims.

What is claimed is:

1. A refrigerator comprising:

a main body having a freezing chamber, a switchable chamber and a refrigerating chamber, both the freezing chamber and the switchable chamber communicating with the refrigerating chamber;

a duct including a first duct through which the freezing chamber communicates with the refrigerating chamber and a second duct through which the switchable chamber communicates with the refrigerating chamber;

a damper to control flow of cold air through the duct;

a compressor connected with a compressor suction path and a compressor discharging path;

a condenser connected with the compressor discharging path and connected with a condenser discharging path;

a switchable chamber evaporator to cool the switchable chamber;

a freezing chamber evaporator connected with the switchable chamber evaporator through an evaporator connection path to cool the freezing chamber;

a switchable chamber capillary tube connected with the switchable chamber evaporator;

a bypass capillary tube connected with the evaporator connection path;

a valve connected with the condenser discharging path, the switchable chamber capillary tube and the bypass capillary tube to guide refrigerant flowing in the condenser discharging path to the switchable chamber capillary tube or the bypass capillary tube based on control from a controller;

a switchable chamber fan to blow cold air to the switchable chamber evaporator and to blow the cold air in the switchable chamber and to the duct; and a freezing chamber fan to blow cold air to the freezing chamber evaporator and to blow the cold air in the freezing chamber and to the duct, wherein the controller closes the damper when a temperature of the refrigerating chamber is satisfied, wherein when the temperature of the refrigerating chamber is not satisfied and a target temperature of the switchable chamber exceeds a set temperature, the controller opens the damper, and the controller rotates the switchable chamber fan and the freezing chamber fan at different speeds regardless of satisfaction or non-satisfaction of the temperature of the switchable chamber and satisfaction or non-satisfaction of the temperature of the freezing chamber.

2. The refrigerator of claim 1, wherein, when the target temperature of the switchable chamber exceeds the set temperature, the temperature of the refrigerating chamber is not satisfied, the temperature of the switchable chamber is not satisfied and the temperature of the freezing chamber is not satisfied, the controller:

controls the valve to allow the refrigerant to flow to the switchable chamber evaporator and freezing chamber evaporator in series, and rotates the switchable chamber fan at a higher speed than the freezing chamber fan.

3. The refrigerator of claim 1, wherein, when the target temperature of the switchable chamber exceeds the set temperature, the temperature of the refrigerating chamber is not satisfied, the temperature of the switchable chamber is satisfied and the temperature of the freezing chamber is satisfied, the controller:

closes the valve, and rotates the freezing chamber fan at a higher speed than the switchable chamber fan.

4. The refrigerator of claim 1, wherein, when the target temperature of the switchable chamber exceeds the set temperature, the temperature of the refrigerating chamber is not satisfied the temperature of the switchable chamber is not satisfied and the temperature of the freezing chamber is satisfied, the controller:

controls the valve to allow the refrigerant to flow to the switchable chamber evaporator and freezing chamber evaporator in series, and rotates the switchable chamber fan at a higher speed than the freezing chamber fan.

5. The refrigerator of claim 1, wherein, when the target temperature of the switchable chamber exceeds the set temperature, the temperature of the refrigerating chamber is not satisfied, the temperature of the switchable chamber is satisfied and the temperature of the freezing chamber is not satisfied, the controller:

controls the valve to a freezing chamber mode, and rotates the freezing chamber fan at a higher speed than the switchable chamber fan.

6. The refrigerator of claim 1, wherein, when the target temperature of the switchable chamber exceeds the set temperature, the temperature of the refrigerating chamber is satisfied, the temperature of the switchable chamber is satisfied and the temperature of the freezing chamber is not satisfied, the controller:

controls the valve to a freezing chamber mode, and rotates the freezing chamber fan at a middle speed between a high speed and a low speed of the freezing chamber fan and stops the switchable chamber fan.

7. The refrigerator of claim 1, wherein, when the target temperature of the switchable chamber exceeds the set temperature, the temperature of the refrigerating chamber is satisfied, the temperature of the switchable chamber is not satisfied and the temperature of the freezing chamber is satisfied, the controller:

controls the valve to allow the refrigerant to flow to the switchable chamber evaporator and freezing chamber evaporator in series, and rotates the switchable chamber fan at a middle speed between a high speed and a low speed of the switchable chamber fan and stops the freezing chamber fan.

8. The refrigerator of claim 1, wherein, when the target temperature of the switchable chamber exceeds the set temperature, the temperature of the refrigerating chamber is satisfied, the temperature of the switchable chamber is not satisfied and the temperature of the freezing chamber is not satisfied, the controller:

controls the valve to allow the refrigerant to flow to the switchable chamber evaporator and freezing chamber evaporator in series, and rotates the switchable chamber fan and the freezing chamber fan at a middle speed between a high speed and a low speed of the respective switchable chamber fan and the freezing chamber fan.

9. The refrigerator of claim 1, wherein, when the target temperature of the switchable chamber exceeds the set temperature, the temperature of the refrigerating chamber is satisfied, the temperature of the switchable chamber is satisfied and the temperature of the freezing chamber is satisfied, the controller:

closes the valve, and stops the switchable chamber fan and the freezing chamber fan.

10. The refrigerator of claim 1, wherein, when the target temperature of the switchable chamber is equal to or less than the set temperature, the temperature of the refrigerating chamber is not satisfied, the temperature of the switchable chamber is not satisfied and the temperature of the freezing chamber is not satisfied, the controller:

controls the valve to allow the refrigerant to flow to the switchable chamber evaporator and freezing chamber evaporator in series, and rotates the switchable chamber fan and the freezing chamber fan at a middle speed between a high speed and a low speed of the respective switchable chamber fan and the freezing chamber fan.

11. The refrigerator of claim 1, wherein, when the target temperature of the switchable chamber is equal to or less than the set temperature, the temperature of the refrigerating chamber is not satisfied, the temperature of the switchable chamber is satisfied and the temperature of the freezing chamber is satisfied, the controller:

closes the valve, and rotates the switchable chamber fan and the freezing chamber fan at a middle speed between a high speed and a low speed of the respective switchable chamber fan and the freezing chamber fan.

12. The refrigerator of claim 1, wherein, when the target temperature of the switchable chamber is equal to or less than the set temperature, the temperature of the refrigerating chamber is not satisfied, the temperature of the switchable chamber is not satisfied and the temperature of the freezing chamber is satisfied, the controller:

controls the valve to allow the refrigerant to flow to the switchable chamber evaporator and freezing chamber evaporator in series, and rotates the switchable chamber fan at a higher speed than the freezing chamber fan.

13. The refrigerator of claim 1, wherein, when the target temperature of the switchable chamber is equal to or less than the set temperature, the temperature of the refrigerating chamber is not satisfied, the temperature of the switchable chamber is satisfied and the temperature of the freezing chamber is not satisfied, the controller:

controls the valve to a freezing chamber mode, and rotates the freezing chamber fan at a higher speed than the switchable chamber fan.

14. The refrigerator of claim 1, wherein, when the target temperature of the switchable chamber is equal to or less than the set temperature, the temperature of the refrigerating chamber is satisfied, the temperature of the switchable chamber is satisfied and the temperature of the freezing chamber is not satisfied, the controller:

controls the valve to a freezing chamber mode, and rotates the freezing chamber fan at a middle speed between a high speed and a low speed of the freezing chamber fan and stops the switchable chamber fan.

15. The refrigerator of claim 1, wherein, when the target temperature of the switchable chamber is equal to or less than the set temperature, the temperature of the refrigerating chamber is satisfied, the temperature of the switchable chamber is not satisfied and the temperature of the freezing chamber is satisfied, the controller:

controls the valve to allow the refrigerant to flow to the switchable chamber evaporator and freezing chamber evaporator in series, and rotates the switchable chamber fan at a middle speed between a high speed and a low speed of the switchable chamber fan and stops the freezing chamber fan.

16. The refrigerator of claim 1, wherein, when the target temperature of the switchable chamber is equal to or less than the set temperature, the temperature of the refrigerating chamber is satisfied, the temperature of the switchable chamber is not satisfied and the temperature of the freezing chamber is not satisfied, the controller:

controls the valve to allow the refrigerant to flow to the switchable chamber evaporator and freezing chamber evaporator in series, and rotates the switchable chamber fan and the freezing chamber fan at a middle speed between a high speed and a low speed of the respective switchable chamber fan and the freezing chamber fan.

17. The refrigerator of claim 1, wherein, when the target temperature of the switchable chamber is equal to or less than the set temperature, the temperature of the refrigerating chamber is satisfied, the temperature of the switchable chamber is satisfied and the temperature of the freezing chamber is satisfied, the controller:

closes the valve, and stops the switchable chamber fan and the freezing chamber fan.

18. The refrigerator of claim 1, wherein the set temperature is higher than a maximum target temperature of the freezing chamber.

* * * * *